US006148775A

United States Patent [19]

Farrington

[11] Patent Number: 6,148,775

[45] Date of Patent: Nov. 21, 2000

[54] ORBITAL INTERNAL COMBUSTION ENGINE

[76] Inventor: Michael C. R. Farrington, 1610 Richardson Rd., Merritt Island, Fla. 32952

[21] Appl. No.: 08/990,544

[22] Filed: Dec. 15, 1997

Related U.S. Application Data

[63] Continuation-in-part of application No. 08/528,922, Sep. 15, 1995, abandoned.

[51] Int. Cl.[7] ..... F02B 57/06

[52] U.S. Cl. ..... 123/44 C; 123/44 D; 123/310

[58] Field of Search ..... 123/44 R, 44 C, 123/44 D, 310, 636, 638

[56] References Cited

U.S. PATENT DOCUMENTS

| | | | |
|---|---|---|---|
| 989,221 | 4/1911 | Allyn | 123/44 C |
| 1,019,856 | 3/1912 | Strickland | 123/44 C |
| 1,443,282 | 1/1923 | Scott | 123/44 C |
| 1,674,568 | 6/1928 | Raab | 123/44 C |
| 2,324,705 | 7/1943 | Huber | 123/310 |
| 2,683,422 | 7/1954 | Richards | 123/44 R |
| 3,517,651 | 6/1970 | Graybill | 123/44 C |
| 3,599,612 | 8/1971 | Villella | 123/44 D |
| 3,921,602 | 11/1975 | Froumajou | 123/44 D |
| 4,040,398 | 8/1977 | Billings et al. | 123/44 R |
| 5,375,564 | 12/1994 | Gail | 123/44 D |

FOREIGN PATENT DOCUMENTS

| | | | |
|---|---|---|---|
| 210960 | 2/1987 | European Pat. Off. | 123/44 R |

*Primary Examiner*—Michael Koczo

[57] ABSTRACT

An orbital internal combustion engine including a pair of rigidly interconnected opposed cylinders having a pair of rigidly interconnected pistons reciprocally mounted therein with the pistons each including a rigid piston rod rotatably journaled to a crank throw on a crankshaft. The rotatable cylinders and the crankshaft rotate about axes that are spaced in relation to each other whereby the cylinders orbit in relation to the crankshaft and crank throw to impart a power stroke of 360 degrees to the crankshaft when the cylinders have orbited 180 degrees. Each piston includes a crown with recesses on each side thereof associated with a pair of spark plugs in the cylinder head to shape the charge formed by the combustible mixture for imparting a greater expansion force against the piston rather than against the cylinder wall. The cylinders are oriented in a cowling and provided with fins for supplying clean air to a intake manifold which supplies a combustible mixture through ports into each cylinder with exhaust ports also provided in each cylinder, whereby rotation of the cylinders provides a rotary valve for the intake and exhaust and the reciprocating piston forms a sliding valve for the intake ports and exhaust ports.

3 Claims, 5 Drawing Sheets

ORBITAL INTERNAL COMBUSTION ENGINE

CROSS-REFERENCE TO RELATED APPLICATIONS

This application is a continuation-in-part of patent application Ser. No. 08/528,922, filed Sep. 15, 1995, abandoned.

BACKGROUND OF THE INVENTION

1. Field of the Invention

The present invention generally relates to internal combustion engines and more particularly to an engine utilizing and opposed piston and cylinder set connected with the crank throw of the crankshaft in which the piston and cylinder set rotates in an orbit about an axis spaced from the rotational axis of the crankshaft to provide an engine in which the power stroke during expansion of the burning fuel and air mixture extends for a full 360 degree rotation of the crankshaft and crank throw while the cylinder set has rotated only 180 degrees.

2. Description of the Prior Art

Various internal combustion engines have been designed and developed in a continuing effort to improve the efficiency of the internal combustion engine in converting the expanding properties of a burning combustible mixture to a driving force on a piston, pistons or rotor in order to obtain useful mechanical energy. However, existing internal combustion engines are relatively inefficient in that a substantial portion of the thermal energy in the combustible mixture is wasted and environmental pollution agents are discharged as an exhaust into the atmosphere.

For example, the internal combustion engine design can waste up to 97% of its fuel at high revolutions per minutes (RPMs), their contained thermal energy. This energy released by fuel combustion is due to design fault creating improper oxygenation of the fuel, as well as friction and heat due to numerous unnecessary moving parts to burn the fuel. Gasoline, the most utilized of all fuels for internal combustion engines, requires 14 parts of oxygen to one part of fuel for proper combustion. In prior engines, the volume of fuel/air mixtures is restricted to the amount of air in the cylinder due to the air volume allowed by the vacuum created by the piston's reciprocation. To accelerate, more fuel is added to the restricted amount of air destroying proper fuel air mixture in which case the greatest percentage of fuel does not have sufficient oxygen to combust, is vaporized by the heat created by combustion and pushed out the exhaust valves by the reciprocation of the exhaust stroke and such reciprocation is controlled in two and four cycle engines by the crank throw or lever. Thus, a one-inch throw with a rotation of 180 degrees causes a two inch reciprocation of the piston in relation to the cylinder head. The volume of that cylinder is restricted to the diameter of the cylinder and the length of the piston stroke. The volume of the air being drawn in is created by the vacuum of the piston stroke on the intake. As fuel is added to accelerate, the required 14 parts of air to one part of fuel in relation to gasoline provides an incorrect fuel to air mixture that creates more inefficiency as more acceleration is required. Since the cylinder volume is constant, each addition of fuel per cubic centimeter deducts from the air volume to properly burn, and cuts the efficiency of the heat expansion of the fuel. Further, the more fuel utilized per cubic inch the greater the waste through the exhaust system. Such fuel waste in turn causes the need for anti-pollution devices, thus creating back pressure in the exhaust system restricting proper scavenging of exhaust gases and restricting proper fuel/air volume.

Attempts to increase the volume of oxygen in the cylinder by the use of turbos, blowers, and oxygenated fuels have been of such small improvement as to be impractical in low-level atmospheric pressures. Usually, the use of alcohol additives because of their water content, and the use of water injection in aircraft and high-performance engines is restricted. In the present design of the two and four cycle engine, alcohol or water addition is restricted to ten percent or less, and water injection is restricted to ten to thirty seconds in the valve systems of the present four cycle internal combustion engines.

The use of sodium valves in high-performance engines burn, melt, or explode from the proper oxygenation requirement for the fuel efficiency of the heat created by the fuel combustion. The diesel engine at this time is probably the most efficient as it is designed to operate at high temperatures with more air displacement in the cylinder and slower burning fuels (kerosene-diesel) causing a pressure against the piston for a longer period of time. The additive of lead to gasoline to retard the burning and cause pressure against the piston of the four cycle engine for a greater period has been outlawed due to the lead pollutants which have caused gasoline to be even more dangerous. The system of ports rather than the complex valve system of the four cycle engine utilizes a more efficient fuel energy due to the placement in relation to the piston position at the end of its power stroke.

SUMMARY OF THE INVENTION

The present invention is an orbital internal combustion engine. It differs from engines described as rotary and from engines that are stationary and sometimes termed inertia engines, that require extremely high RPMs causing both heat and friction with poor fuel economy, pollution and energy waste of fuel. The orbital engine of the present invention utilizes the existing forces created by the action of rotation and a high level of the thermal energy with a simplicity requiring an absolute minimum of components. In comparison to the four cycle engine, which requires the engine to reciprocate 16 times to achieve a 360 degree crank rotation under power, this rotation is achieved by the orbital engine of the present invention in a single stroke. This rotation is also achieved in the present invention without the useless action of unnecessary intake, compression, and exhaust strokes, as well as no reduction of power for a valve system.

The innovative features of the orbital engine of the present invention include: 1) The principal and unique design of the orbital piston engine increases the cylinder volume seventy percent (70%) in relation to the ordinary dimension of the crank throw of conventional two and four cycle engines. 2) One power stroke causes the rotation of the crankshaft three hundred and sixty degrees (360 degrees) under power. 3) A unique system of ports, utilizing centrifugal force created by the engine's rotation, properly provides charging of the cylinder without fuel or air waste. 4) The rotation of the engine through the constant fresh air flow is not dependent on fans or blowers and provides proper temperature control. 5) A four cylinder engine of the present invention requires only four moving parts: two piston sets; the crankshaft and the engine rotating on fixed engine mounts. 6) In most uses, a cowling surrounds the rotating engine and provides a unique ignition system, temperature control of the engine, as well as enabling the engine to operate in either a clockwise or counter clockwise rotation by reversing a switch. 7) Positive lubrication is provided, as all working parts of the engine operate in a constant lubricant, including all bearings and piston interiors feeding the oil rings. 8) Piston crowns are designed not only to direct the air/fuel mixture to the top of the cylinder, but on completed compression, to shape the fuel mixture into a configuration which directs the energy largely against the piston crown with a minimum energy waste against the cylinder walls and head. 9) Reduced weight to horsepower output is achieved by increased efficiency of all aspects of the orbital engine. A minimum of working parts, maximum horsepower at significantly low RPMs and lack of friction due to an unusual lubricating system requiring no pumps or filter system. 10) The orbital engine has a simplicity of design with extremely low fuel consumption compared to conventional two and four cycle engines, absolute minimum cost of manufacturing and a practically non-polluting internal combustion engine.

Accordingly, an object of the present invention is to provide an orbital internal combustion engine by which thermal efficiency has been materially increased as compared to existing engines due to extreme fuel economy as well as a more complete combustion of the fuel.

Another object of the invention is to provide an orbital internal combustion engine by which the environmental pollution discharge from the engine has been materially reduced as compared to existing engines.

A further object of the invention is to provide an orbital internal combustion engine in which a set of opposed cylinders receiving a set of opposed pistons rotate about a rotational axis that is spaced from the rotational axis of the crankshaft and the crankshaft throw.

Still another object of the invention is to provide an orbital internal combustion engine as set forth in the preceding object in which the cylinder and piston sets orbit 180 degrees, while the crank throw and crankshaft orbit 360 degrees, with the expansion force of the burning combustible mixture exerting force on the pistons throughout the 360 degree rotation of the crankshaft.

Yet another important object of the invention is to provide an orbital internal combustion engine in accordance with the preceding objects in which a crank case rigidly interconnects the cylinder sets and each cylinder includes inlet ports for a combustible mixture and outlet ports for exhausting combustion products with the ports being opened and closed by the pistons during their reciprocation in the cylinders and utilizing centrifugal force for movement of the combustible mixture toward the interior of the cylinder head.

A still further object of the invention is to provide an internal combustion engine in which the piston includes a diagonal crown with a pair of curved concave, generally cylindrical recesses on each side of the crown for alignment with spark plugs in the cylinder head to provide the effect of a shaped charge to the burning combustible mixture to exert most of the force from the expanding combustible mixture to the piston rather than to the cylinder wall.

Another significant object of the invention is to provide an internal combustion engine in which the cylinders are provided with air cooling external fins and in some cases cowling with the angled fins drawing air to the cylinder and crank case along with fuel to provide a combustible mixture to the inlet ports.

A final object of the invention to be recited herein is to provide an orbital internal combustion engine having a magneto structure that produces electrical energy transmitted to the spark plugs by virtue of the spark plugs coming into contact with charged contacts in a cowling as the cylinders rotate.

These together with other objects and advantages which will become subsequently apparent reside in the details of construction and operation as more fully hereinafter described and claimed, reference being had to the accompanying drawings forming a part hereof, wherein like numbers refer to like parts throughout.

DESCRIPTION OF THE PREFERRED EMBODIMENT

Figure 1A:
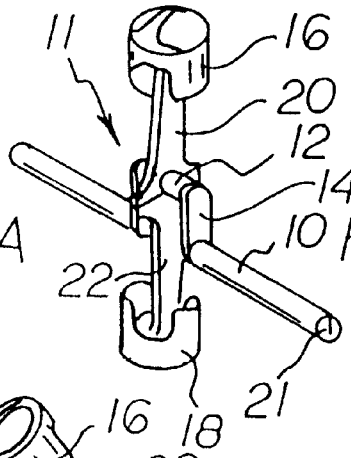
FIGS. 1A–H illustrates schematically the relative movement of a piston set and thus the cylinders to the crankshaft throw and axis, during one power stroke about the crank throw for a 180 degrees rotation, while the crank throw and crankshaft are rotated 360 degrees thereby providing a 360 degree power stroke to the crankshaft for each 180 degrees rotational movement of the cylinders and pistons in the orbital engine of the present invention.

FIGS. 1A through 1H illustrate schematically the 360 degree rotational movement of crankshaft 10 during one power stroke of piston set 11 about a crank throw 12 of only 180 degrees. This leveraged rotation is achieved by offsetting crank throw 12 from the crankshaft 10 by crank arms 14 thereby moving the crank throw 12 in a circular path having the same axis as the rotational axis of the crankshaft 10. The piston set 11 comprises a pair of rigidly connected opposed pistons 16 and 18 which are rigid with piston rods 20 and 22, which in turn are rotatably journaled on the crank throw 12. Thus, the pistons 16, 18 and piston rods 20, 22 are a rigid unit but the piston rods 20 and 22 are rotatably journaled on the crank throw 12.

Figure 1B:
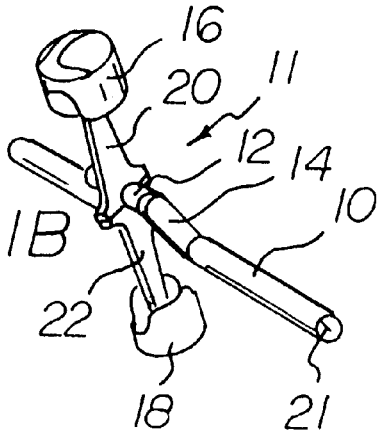
Figure 1C:
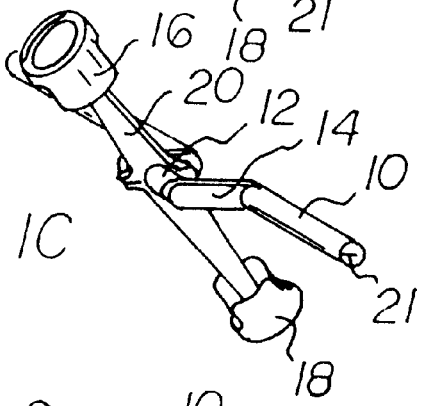
Figure 1D:
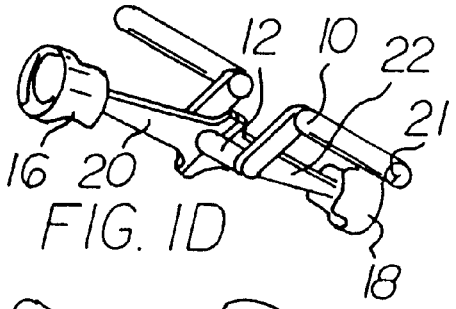
Figure 1E:
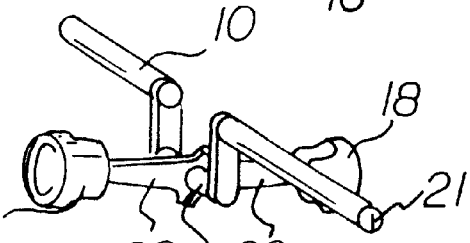
Figure 1F:
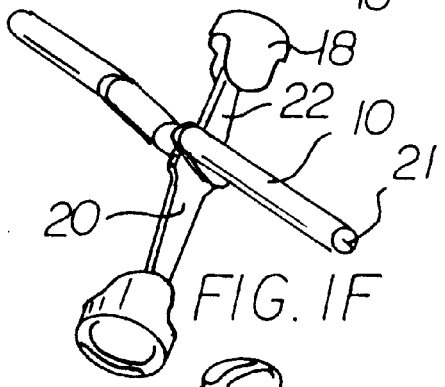
Figure 1G:
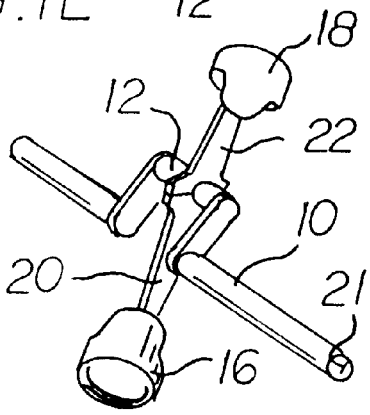
Figure 1H:
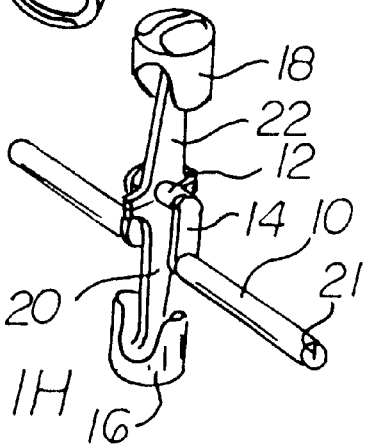

FIG. 1A illustrates the piston 16 positioned 7 degrees from top center. The radial marker 21 shown on the near end of crankshaft 10 is positioned at twelve o'clock. FIG. 1B illustrates the piston 16 with piston rod 20 and piston 18 with piston rod 22 orbited 25 degrees to create a 37 degrees rotation of the crankshaft 10. FIG. 1C illustrates the piston set orbited 50 degrees resulting in a 90 degree rotation of the crankshaft (see marker 21 pointing to nine o'clock). FIG. 1D illustrates a 75 degree orbit of the piston set and 130 degree rotation of the crankshaft FIG. 1E illustrates a 90 degree orbit of the piston set and a 180 degrees rotation of the crankshaft (marker 21 is now pointing at 6 o'clock). FIG. 1F illustrates 125 degree orbit of the piston set and 195 degree rotation of the crankshaft. FIG. 1G illustrates a 150 degree orbit of the piston set and a 260 degree rotation of the crankshaft, and FIG. 1H illustrates a 180 degree orbit of the piston set and a 360 degree rotation of the crankshaft.

Marker 21 has now returned to the 12 o'clock position. Thus, for each 180 degree orbit movement of the piston set there is a corresponding 360 degree rotation of the crankshaft. Hence, as pressure is exerted on the piston 16 during its power stroke, the piston 16 (and piston 18) orbits 180 degree and the power stroke extends 180 degree. In contrast, the crankshaft is provided with power for 360 degree rotation, or a complete revolution.

Figure 2:
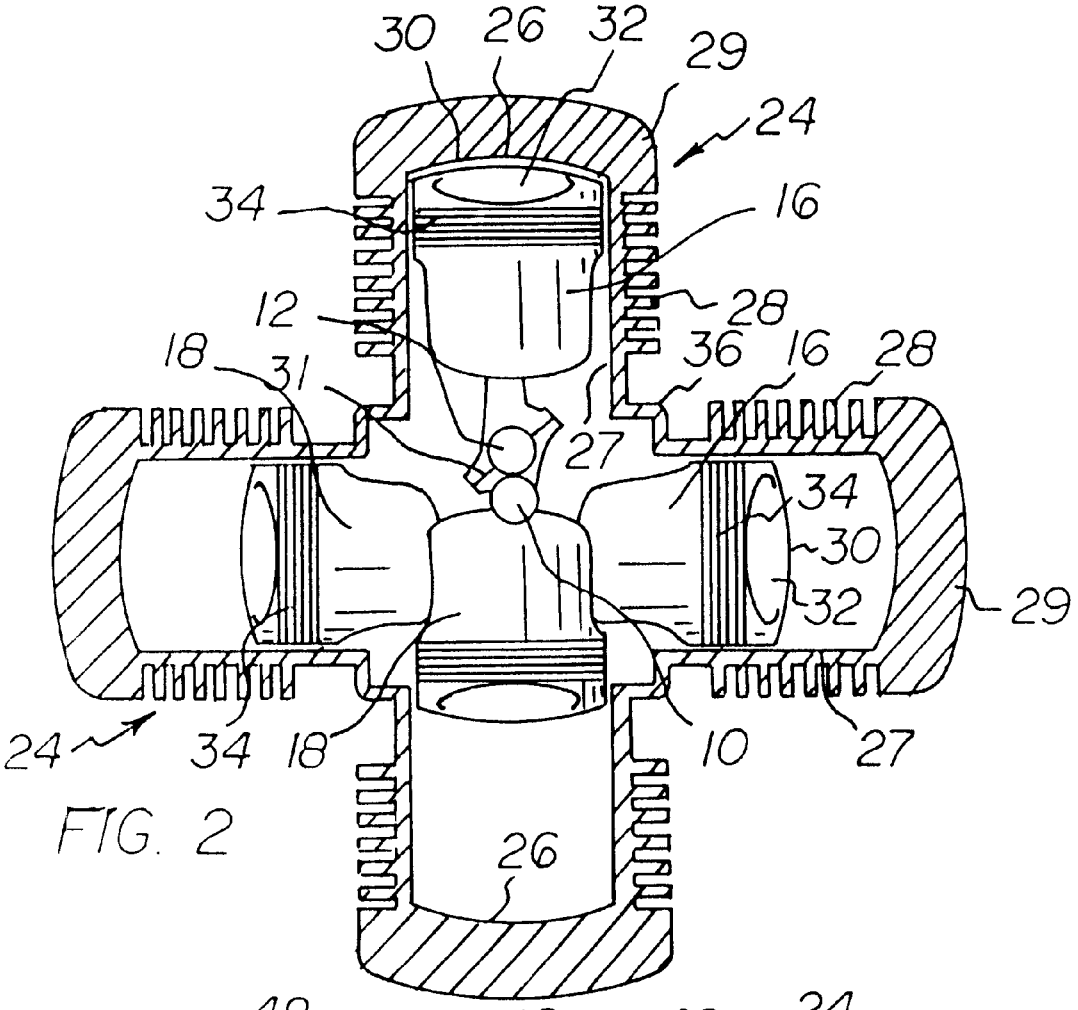
FIG. 2 is a partial sectional view of a four cylinder arrangement of the orbital internal combustion engine of this invention.

FIG. 2 illustrates in partial section the arrangement in which two sets of opposed cylinders and corresponding piston and crankshaft assemblies are utilized, with each of the four cylinders being designated generally by reference numeral 24. Each cylinder is provided with a cylinder head 26 having an inner surface with a slight arcuate concave curvature. Both the side walls 27 and the cylinder head 26 of each cylinder 24 are provided with air cooling fins 28 and 29, respectively, projecting from the outer surface of the cylinder in spaced relation for maintaining operating temperature of the engine. As shown, each piston set of two pistons 16 and 18 and their respective piston rods 20 and 22 are preferably cast and machined as one piece. They are then separated at a 450 angle, as at 31, and bored for the purpose of affixing the rods 20 and 22 around the related crank throw 12.

Each of the pistons includes a diametric crown 30 which is convexly curved in the same degree as the curvature of the inner surface of the cylinder head 26. On each side of the central transversely extending crown 30, the piston is provided with a convexly curved recess 32. Each piston wall is provided with a plurality of spaced rings 34 below the crown and below the recesses to sealingly engage the piston with the internal wall of the cylinder 24 in a known manner. The cylinders 24 are rigidly affixed with relation to each other by a crank case 36, with the crank case 36, cylinders 24 and cooling fins 28 and 29 being of rigid construction. The cooling fins 29 on the cylinder head are canted or angled for the purpose of directing clean fresh air drawn into a shroud or cowling as illustrated in FIG. 4 and designated generally by reference numeral 40.

Figure 3:
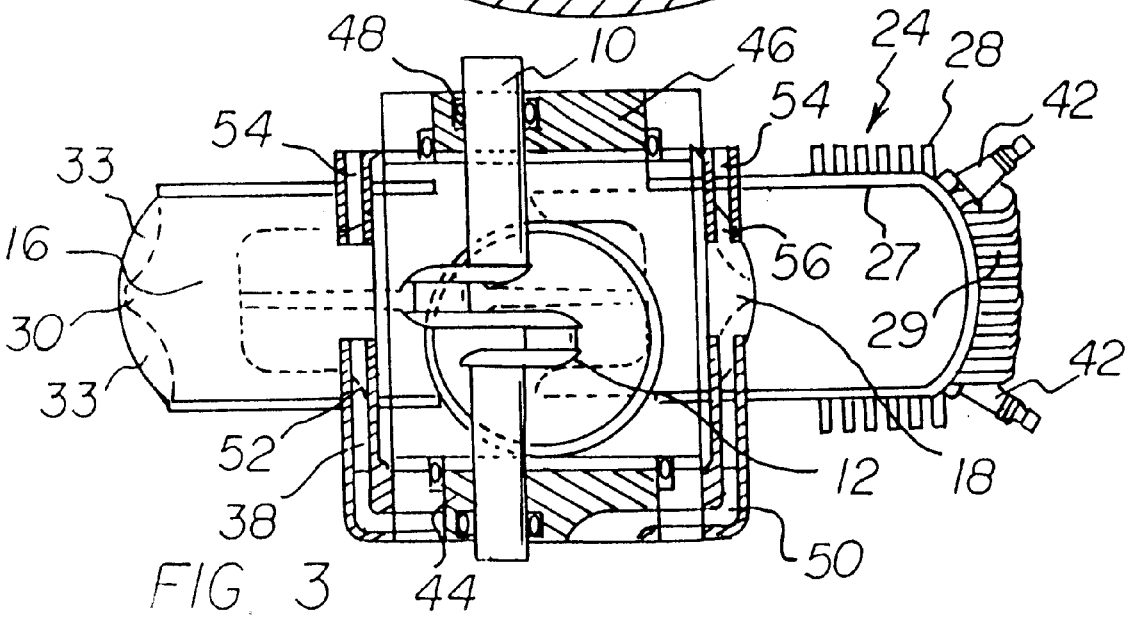
FIG. 3 is a schematic sectional view of the crank case illustrating the motor mounts, intake manifold and exhaust manifold and other components of the orbital internal combustion engine of this invention.

FIG. 3 illustrates the side view of one piston set and the unique design of the piston crown. A pair of spark plugs 42 are positioned in each cylinder head and aligned with the recesses 32 on opposite sides of the crown 30 on the piston. The conformation of the cylinder head curvature and the configuration of the piston crown as shown in the left side of FIG. 3, and described above, is such that the fuel air mixture is compressed into the two pockets 33 formed by the recesses 32 so that the force of the burning combustible mixture is directed against the piston head or crown and the cylinder walls, similar to the manner in which a shaped charge functions in demolition of armor piercing procedures.

FIG. 3 also illustrates the complete crankshaft assembly including crankshaft 10 and crank throw 12, as would be present in a four cylinder engine, such as illustrated in FIG. 2. Forward motor mount 44 and rear motor mount 46 rotatably support the crankshaft 10 by bearing and seal assemblies 48 which form a closure for the crank case where the crankshaft extends through to retain lubricating oil within the crank case. The forward motor mount 44 is provided with an air intake manifold 50 and rear motor mount 46 is provided with air exhaust manifold 54 which cooperate with rotation of the cylinders 24 to create a rotary valve system that does not deduct horsepower from the power stroke of the pistons, as described in further detail below in connection with FIG. 4. The orbital engine is not restricted in the number of piston sets and cylinders but must always be in sets of two opposed pistons. The two cylinder and four cylinder arrangements are clear from FIG. 2. If six or more cylinders are desired, they should be stacked.

Figure 4:
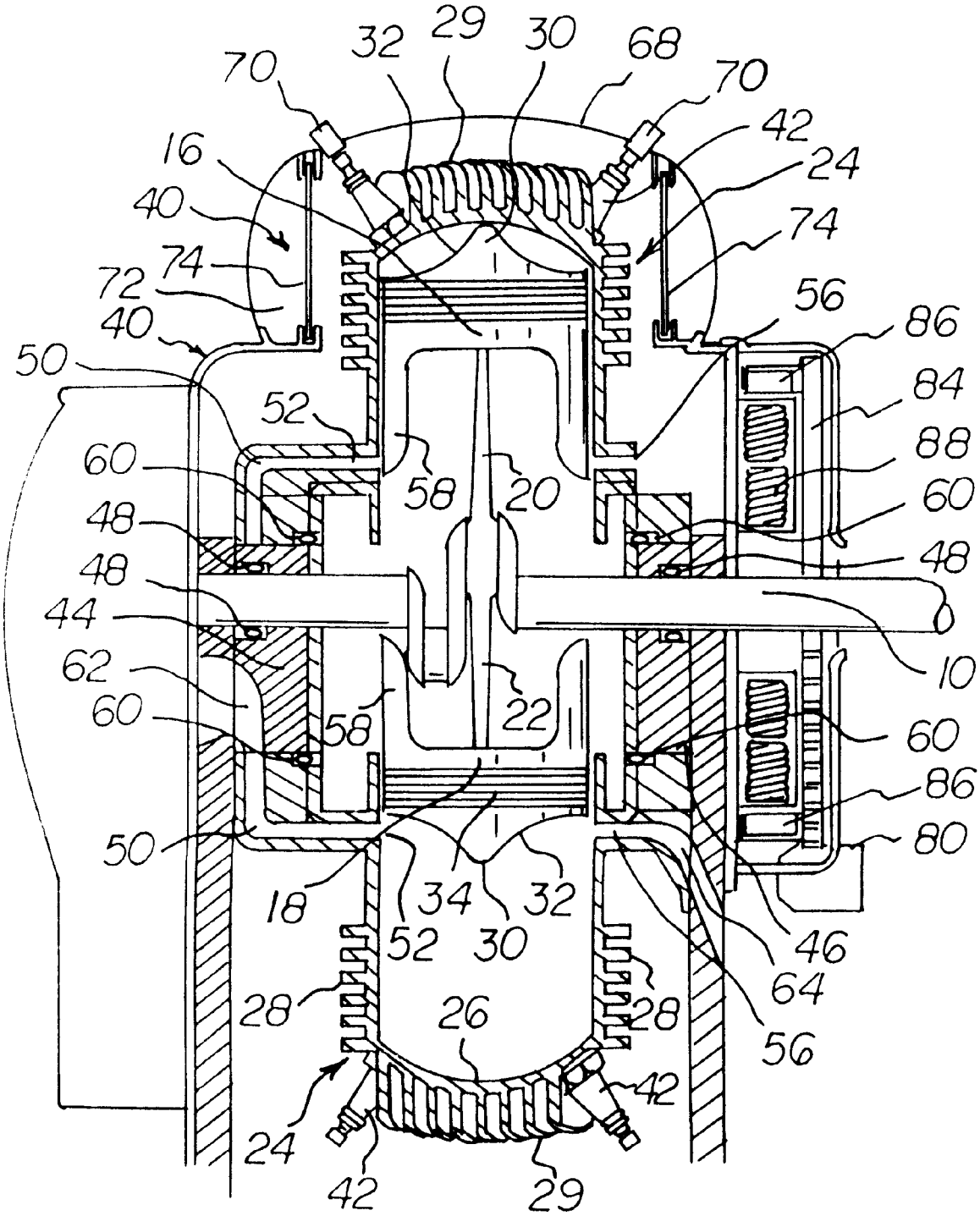
FIG. 4 is a partial sectional view of the engine of the present invention illustrating further structural details the magnetos as well as the alternator coil is encompassed in the starter ring to which magnets have been affixed and whose rotation deducts no useable horse power from the engine including the magneto and the orientation of the cowling and contacts for providing an ignition charge to the spark plugs.

FIG. 4 illustrates the relationship of the intake manifold 50 to inlet ports 52 in the cylinder wall and the relationship of exhaust manifold 54 to exhaust ports 56 in the cylinder wall. The pistons 16 and 18 include a skirt 58 which cooperates with the ports 52 and 56 to open and close the ports during reciprocation of the piston set.

As also illustrated in FIG. 4, seal structures 60 associated between the motor mounts 44 and 46 and the crank case 36 provide a rotational sealed relationship. FIG. 4 also illustrates the relationship of the inlet port 52 of the intake manifold 50 and the exhaust ports 56 of exhaust manifold 54 with an intake passageway 62 and a discharge passageway 64, respectively, in a support structure 66 forming portions of the rigid cowling 40.

Figure 5:
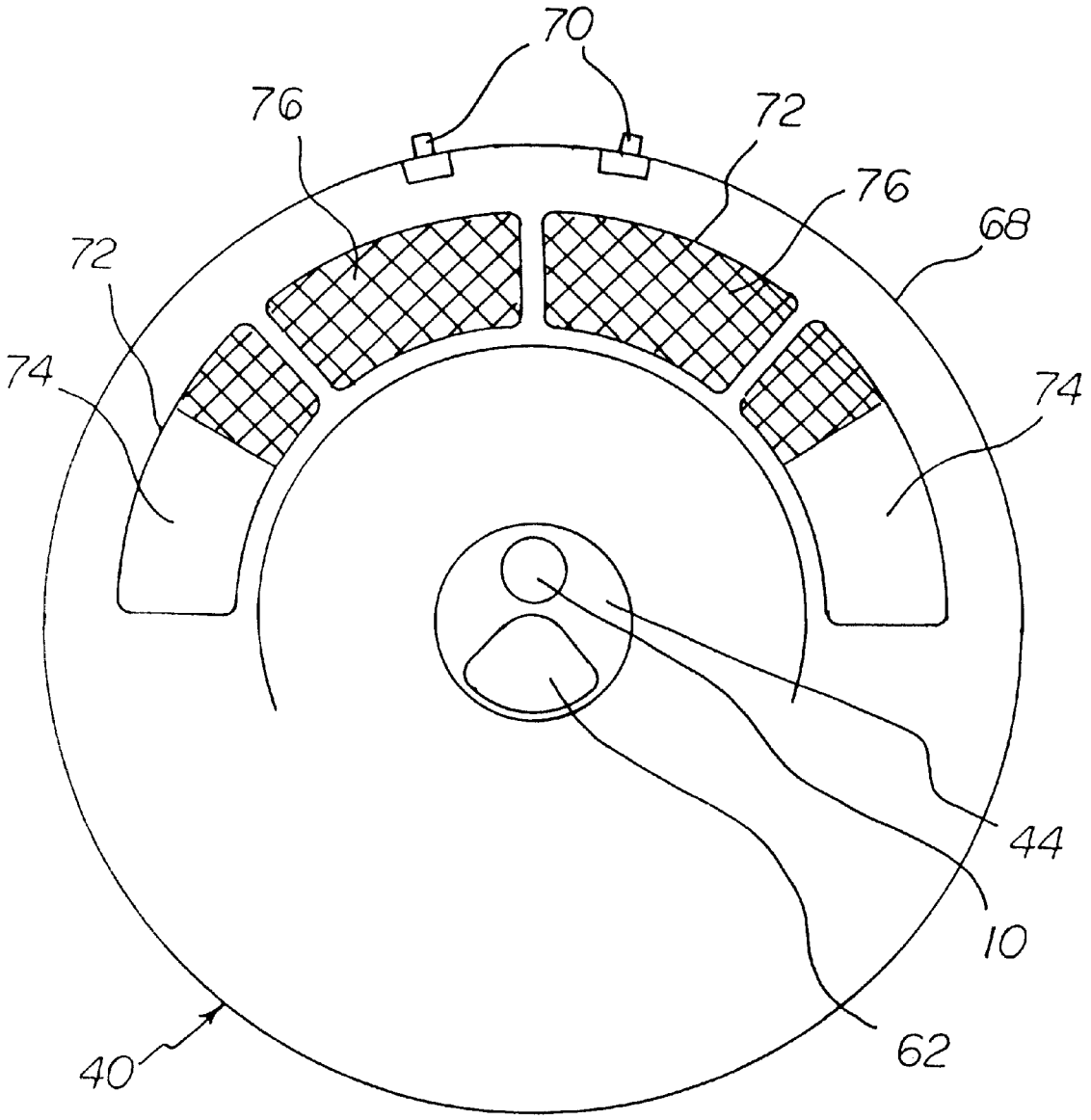
FIG. 5 is a schematic end elevational view illustrating the air intake and orientation of the crankshaft, fuel and air mixture intake and the structure for supporting the cylinders for the engine of this invention.

The cowling 40 encompasses the entire engine and includes an arcuate member 68 having contact members 70 mounted thereon which will engage the spark plugs 42 during rotation of the cylinders with the contact members 70 extending for a predetermined arcuate distance as illustrated in FIG. 5. The contact elements 70 are in pairs on opposite sides of the center line at the top of the arcuate cowling member 68 to enable rotation of the engine in either a clockwise or counterclockwise direction by providing a switch to determine which of the contact members 70 are energized.

The contact points may be mounted in slots and connected with an accelerator or other mechanism to advance or retard the spark in acceleration or deceleration of the engine.

As shown in FIG. 5, the rigid cowling 40 encompasses the entire engine and includes openings 72 provided with shutters 74 which can be adjusted to provide control for the air intake to the engine. The openings include screened vapor filters 76 to provide a supply of clean air to the engine. The shutters also assist in controlling the temperature of the engine and may be thermostatically controlled to allow more or less air to be drawn into the engine by the angle of the head cooling fins 29. The lower end of the cowling 40 may assume various configurations necessitated by the use of the engine where various exhaust systems may be required due to the use of heat from the exhaust system being utilized as well as in some instances, the cooling air within the cowling being mixed with the exhaust.

Referring back to FIG. 4, the intake manifold 50 is opened and closed by the motor mount 44 and the piston skirt 58 opens and closes the intake ports 52 which forms a slider valve system. The exhaust ports 56 and exhaust manifold 54 are also closed in a similar manner. The exhaust ports 56 are opened along with the intake ports 52 when the power stroke has been completed to scavenge combustion products from the cylinder and admit a combustible mixture into the cylinder. Rotation of the cylinders 24 cause the heavier combustible fuel/air mixture to migrate toward the cylinder head. The centrifugal force due to the rotation of the engine not only move s the combustible mixture toward the cylinder head but the heavier components of this mixture assist in expelling the lighter combustion products from the exhaust port. The centrifugal force also serves to compress the combustible mixture as it moves toward the cylinder head.

FIG. 4 also illustrates a starter bendix gear 80 engaged with a starter ring gear 84 has magnets 86 mounted therein which are affixed thereto and rotate about three coil segments 88 to form a magneto. Two of the coil segments provide a constant energy source to the firing contacts 70, and the third coil segment is a part of an alternator encompassing a silicon rectifier diode.

The crank case 36 has lubricant therein which is sealed so that all four moving parts are lubricated by running in oil. The pistons are therefore constantly lubricated by centrifugal force forcing the oil into the piston which is hollow to the point of the oil rings 34 where lubricant passes through openings in the skirt 58 to the cylinder wall 27 in a well known manner.

FIG. 5 illustrates the cowling 40, the firing points 70, the air inlet opening 72, shutters 74 and screened vapor filter 76. Also, the forward motor mount 44 is illustrated along with the fuel and air mixture inlet 62 and the rotational axis of the crankshaft 10. As illustrated, the rotational axis of the crankshaft is offset in relation to the rotational axis of the cylinders and crank case which rotate on the cylindrical motor mounts 44 and 46 as illustrated in FIG. 4. The screened vapor filters through which air being drawn into the cowling for cooling is controlled by the movable shutters which may be thermostatically controlled for proper engine operating temperatures. The forward and rear sections of the cowling are identical. The firing points 70 are preferably oriented 80 from dead center. The left of center firing points 70 cause the engine to operate in a clockwise rotation while the firing points to the right of center operate the engine in a counterclockwise direction. A switch determining the rotation of the engine by energizing the desired contact points 70 also opens or closes shutters in the air intake openings to coincide with the directional operation of the engine whereby the head cooling fins draws air through the rear section of the cowling due to the angle of the fins. The directional switch also causes the opposite rotation of the starter by reversing polarity. Since the starter ring is geared but not a part of the engine proper and since there are no gears, pulleys, cams and the like, the engine can be operated in either clockwise or counterclockwise direction.

Figure 6:
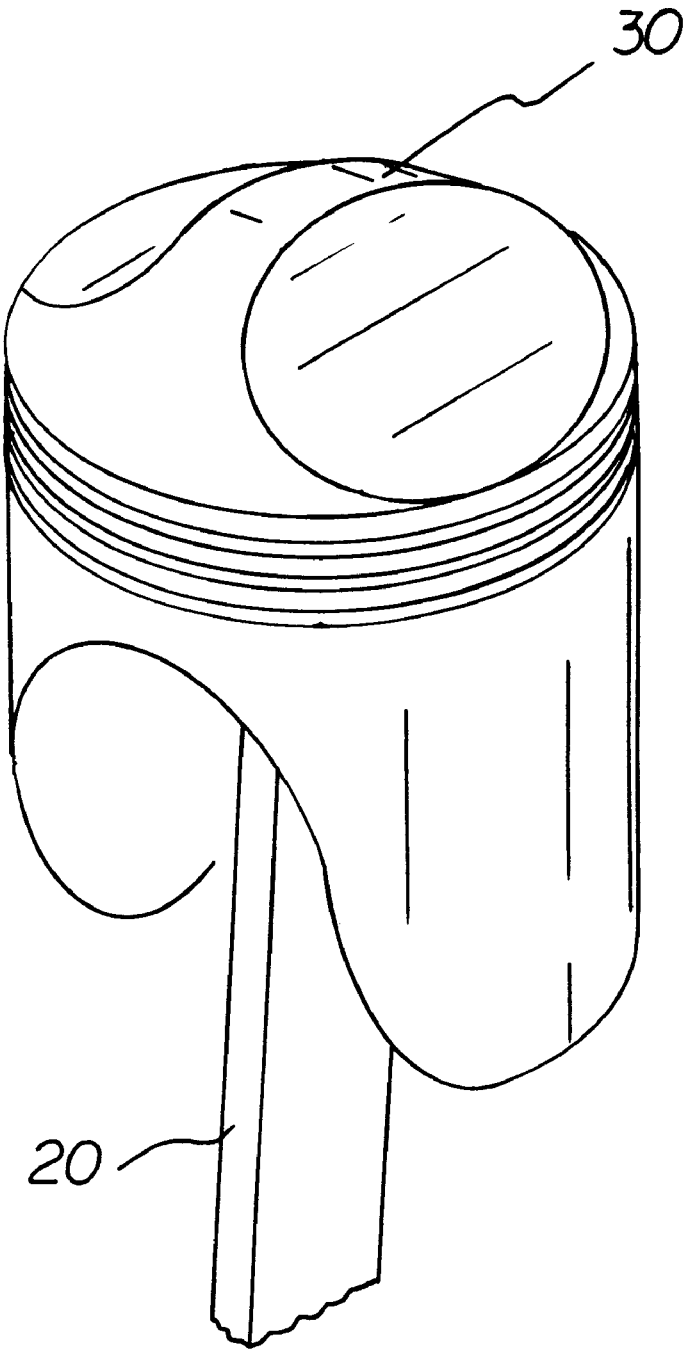
FIG. 6 is a perspective illustration of the crown of one of the pistons.

As can be seen with particular reference to FIG. 6, each piston has a crown 30 in a shape to maximize the efficiency of operation during use. The exteriormost region of the crown is a surface generally in the shape of an hourglass when viewed from the top as shown in FIGS. 1A, 1D and 1F. Such hourglass region is spherically contoured to correspond to the shape of the adjacent interior surface of its associated cylinder head. Note FIGS. 2 and 3. On opposite sides of the exteriormost surface are similarly shaped concave recesses 32. Such recesses each have a central extent positionable adjacent to an associated spark plug 42. Note FIG. 4. It has been found that when fuel enters the intake port of the cylinder adjacent to the interiormost end remote from the spark plug, it will be deflected upwardly by the crown for the purpose of being ignited by the firing spark plugs. This will preclude fuel from directly exiting the cylinder through the adjacent exhaust port prior to ignition with an attendant loss of efficiency. Further, the rotation of the cylinders with fuel to be ignited will create a centrifugal force on the fuel. Furthermore, the fuel will also rotate clockwise in the northern hemisphere, counterclockwise in the southern hemisphere, under the influence of the natural correolis force. The rotation is about an axis coincident with the axis of the cylinder. As a result of these forces, when the spark plugs fire to ignite fuel in the cylinders, the forces generated to drive the piston are significantly greater on the piston than would occur if the cylinder were not rotating and the fuel were not deflected away from the exhaust port. It is believed that this feature of the present invention results from principles long known in the munitions arts but previously unapplied to internal combustion engines. For example, if several sticks of dynamite were placed flat on a rock and simultaneously ignited, the damage to the rock would be minimum. If, however, the dynamite sticks were positioned on the rock in a pyramid or tee-pee fashion, the forces generated by their simultaneous ignition would be significantly magnified with greatly increased damage to the supporting rock.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A rotary power device comprising:

at least one set of opposed cylinders having closed remote ends and open inner ends, each cylinder also having an inlet port and an exhaust port;

a crank case rigidly interconnecting the inner ends of the cylinders and enclosing the space between the cylinders;

a piston reciprocally mounted in each of the cylinders;

engine mounts with a crankshaft rotatably supported by said engine mounts;

a crank throw on said crankshaft in spaced relation to the rotational axis of the crankshaft for movement in a circular path having a center coinciding with the rotational axis of the crankshaft;

a rigid piston rod having opposed ends rigidly connected to each of said pistons, said piston rod being journaled on said crank throw;

bearing surfaces on the engine mounts rotatably supporting the crank case and cylinders for rotation about an axis spaced from the axis of rotation of the crankshaft and for rotation of the cylinders in the same direction as the crankshaft in a manner in which the cylinders and pistons rotate 180 degrees and the crankshaft and crank throw rotate 360 degrees;

the crank case including an inlet manifold and outlet manifold communicating with inlet ports and exhaust ports, said pistons opening and closing said ports during reciprocation;

an opening in each engine mount alignable with said manifolds during a portion of each rotation of the crank case and cylinders, said supports being in contact with the crank case to form a slide valve for each of said manifolds; and an ignition device at the closed end of each cylinder to ignite a compressed combustible mixture for exerting a force on the piston and a power stroke to said crankshaft continuously through the 360 degree rotation of the crankshaft as the cylinders, piston and crank case orbit about the crankshaft during a throw rotation of 360 degrees around the crank axis thereby forming an internal combustion engine with optimum use of thermal energy in the combustible mixture.

2. An internal combustion engine comprising:

a cylinder having a first end with a head having an imperforate section and two laterally spaced spark plugs therein, the cylinder having a second end with an inlet port and an exhaust port;

a piston reciprocable within the cylinder with the piston having a crown formed with a central section in the shape of an hourglass and a generally spherical configuration corresponding to an adjacent portion of the head, the crown also having a pair of generally spherical recesses on opposite sides of, and laterally spaced from, the central section positionable adjacent to the spark plugs for deflecting fuel entering the cylinder from the inlet port toward the spark plugs;

the cylinder and piston being rotatable by the ignition of fuel within the cylinder whereby the fuel being ignited will be acted upon by centrifugal forces and Coriolis forces maximizing power output during ignition.

3. An internal combustion engine having a cylinder with a closed end in a spherical configuration with laterally spaced spark plugs, the cylinder also having a cylindrical side wall with an inlet port cooperable with an inlet manifold and an exhaust port cooperable with an exhaust manifold, and a piston reciprocable within the cylinder, the piston being formed with a cylindrical side wall and a piston crown having a central section in the shape of an hourglass and a generally spherical configuration corresponding to an adjacent portion of the cylinder, the crown also having a pair of generally spherical concave recesses laterally spaced on opposite sides of the central section and positionable adjacent spark plugs of the cylinder for maximizing power output during ignition with the side wall of the piston opening the exhaust port slightly to the exhaust manifold previous to the piston opening the intake port to the intake manifold to relieve the pressure within the cylinder.

* * * * *